US006238145B1

(12) United States Patent
Paul et al.

(10) Patent No.: US 6,238,145 B1
(45) Date of Patent: May 29, 2001

(54) SILO WITH DENSE PHASE DISCHARGE

(75) Inventors: Kermit Paul; Leslie Bartholomew, both of Bethlehem, PA (US)

(73) Assignee: Fuller Bulk Handling Corp., Bethlehem, PA (US)

( * ) Notice: Subject to any disclaimer, the term of this patent is extended or adjusted under 35 U.S.C. 154(b) by 0 days.

(21) Appl. No.: 09/282,087

(22) Filed: Mar. 30, 1999

Related U.S. Application Data

(63) Continuation-in-part of application No. 08/632,233, filed on Apr. 15, 1996, now abandoned.

(51) Int. Cl.[7] ..... B65G 53/40

(52) U.S. Cl. ..... 406/123; 406/91; 52/197; 222/328; 222/547; 222/564

(58) Field of Search ..... 406/90, 91, 122, 406/123; 52/195; 222/328, 547, 564; 414/288, 304, 306

(56) References Cited

U.S. PATENT DOCUMENTS 4,078,703 * 3/1978 Dressler ..... 406/91
4,252,478 * 2/1981 Olle' ..... 406/90
5,562,366 * 10/1996 Paulson ..... 406/12

FOREIGN PATENT DOCUMENTS 62-235130 * 10/1987 (JP) ..... 414/304

* cited by examiner

*Primary Examiner*—Christopher P. Ellis
*Assistant Examiner*—Joe Dillon, Jr.

(57) ABSTRACT

A silo for pulverulent and other loose materials of the type that has a base formed in part by a centrally located, inner conical dome. The silo has a vertically oriented material withdrawal conduit through which the loose materials are withdrawn from the silo. The conduit has an upper end located approximately at the apex of the inner conical dome, and the silo is constructed so that approximately two thirds of its stored contents can be withdrawn by gravity from the lower end of the material withdrawal conduit. The silo may also utilize a plurality of angularly spaced material transport conduits passing radially inward, with a first end of said conduits being located at material outlet points located within the silo body near the inner silo wall and a second end of each of said conduits located at a centrally located collection point within the silo body. The conduits will preferably utilize a dense phase conveying system that utilizes gravity to provide the pressure head to transport material.

9 Claims, 4 Drawing Sheets

SILO WITH DENSE PHASE DISCHARGE

This application claims priority from and is a continuation-in-part of application Ser. No. 08/632,233, filed Apr. 15, 1996 now abandoned.

The invention relates to a silo for pulverulent and fine grained bulk such as cement and other loose materials having a conical cover in the center of a circular silo base.

BACKGROUND OF THE INVENTION

A large volume silo of the inner conical style is known. Such silos are centrally provided with an upwardly extending conical area, along the sloped sides of which the sinking loose material slides into an outer annular area located adjacent to the silo wall. In this outer annular area, which is generally located in the circular silo base between the sides of the central cone and the silo wall, there typically will be particulate outlets through which material will pass to a collection point located outside the silo. Generally, air conveyor chutes will convey the bulk material from such particulate outlets to the outside collection point. Such a collection point is typically a storage tank. Such a design is material intensive, requiring a filter or vent bin in addition to the storage tank.

Typically, the air conveyors utilized in such silos as a means of moving material from within to outside the silo are fluidization conveyors, such as Airslide® fluidization conveyors, which require the fluidization of the bulk material. As a result, the material, which is originally compacted within the silo, must be fluidized and as such will take up more space than when it is in a non-fluidized state, thus requiring large volume, material intensive conveying devices. Obviously, when a fluidization conveying process is utilized the material will have to be separated from the conveying air. Such systems require high air to material ratios, thus placing demands on the system to employ heavy duty filters and the like. Such fluidized conveyors also use a relatively extensive amount of power and incorporate valving, for example, shut-off valves which can be entirely closed or, if desired, opened to a greater or lesser extent, to control material withdrawal.

One object of the invention is to provide a silo in which the material costs are reduced compared to prior art inner cone silos.

A further object of the invention is to provide a silo utilizing internal conveying devices that do not take up as much space or have the same power requirements as the standard fluidizing devices typically utilized in silos.

Another object of the present invention is to provide a silo of the inner cone type in which a significant portion of the stored material can be withdrawn without extensive power requirements.

These and other objects are realized by the silo of the present invention which in the preferred embodiment is of the inner cone type in which, in one embodiment, material is transported from a plurality of particulate outlets arranged in a radial manner on the annular silo base to one or more collection points which, unlike in prior art designs, are located in the interior of the silo body.

The silo design of the present invention eliminates a significant amount of equipment, including the storage tank and any associated filters or vent bin.

SUMMARY OF THE INVENTION

The present invention relates to a silo for bulk material, such as cement powder, ground raw cement, fly ash, raw flour, coal dust, gypsum and the like. In a preferred embodiment the silo of the present invention belongs to the general type that has an annular silo bottom portion formed by an upwardly extending inner conical dome. In one embodiment of the present invention, material conveyors pass radially inward from particulate material outlets located within the silo's interior, and preferably spaced along the silo's annular perimeter, to at least one collection point located within the body of the silo.

In another embodiment of the invention, a novel type of "dense phase" conveying system is used to transport material from a particulate outlet located within the interior of a silo. Such a dense phase conveying system is preferably used to transport material from a particulate outlet spaced along a silo's annular perimeter to a discharge opening. The novel dense phase conveying system of the present invent greatly reduces equipment and maintenance requirements over prior art fluidization conveying methods.

In another embodiment of the present invention, a silo of the inner conical dome type is provided in which material is withdrawn from an approximately centrally located material withdrawal point through which a significant amount, and preferably, a majority, of the silo's contents can be withdrawn by gravity without a significant power expenditure.

In a further embodiment of the present invention, a silo of the inner conical dome type is provided with an essentially vertically oriented central column which functions as a material conduit through which material will be withdrawn from the silo, which column has one end located approximately at the apex of the inner cone and its other end, which is the discharge point for material, located approximately at the center of the cone's base and, therefore, at the bottom of the silo.

BRIEF DESCRIPTION OF THE DRAWINGS

The invention is described in greater detail hereinafter in FIGS. 1–5.

FIGS. 1–5, which are cross-sectional views of various embodiments of the present invention and which are not necessarily drawn to proportion.

FIG. 4 is a cross-sectional view of another embodiment of the withdrawal column 30 of FIG. 1.

FIG. 5 illustrates a downward view, in the direction of arrow V in FIG. 1.

The drawings are not necessarily drawn to scale.

DESCRIPTION OF THE PREFERRED EMBODIMENTS

Figure 1:
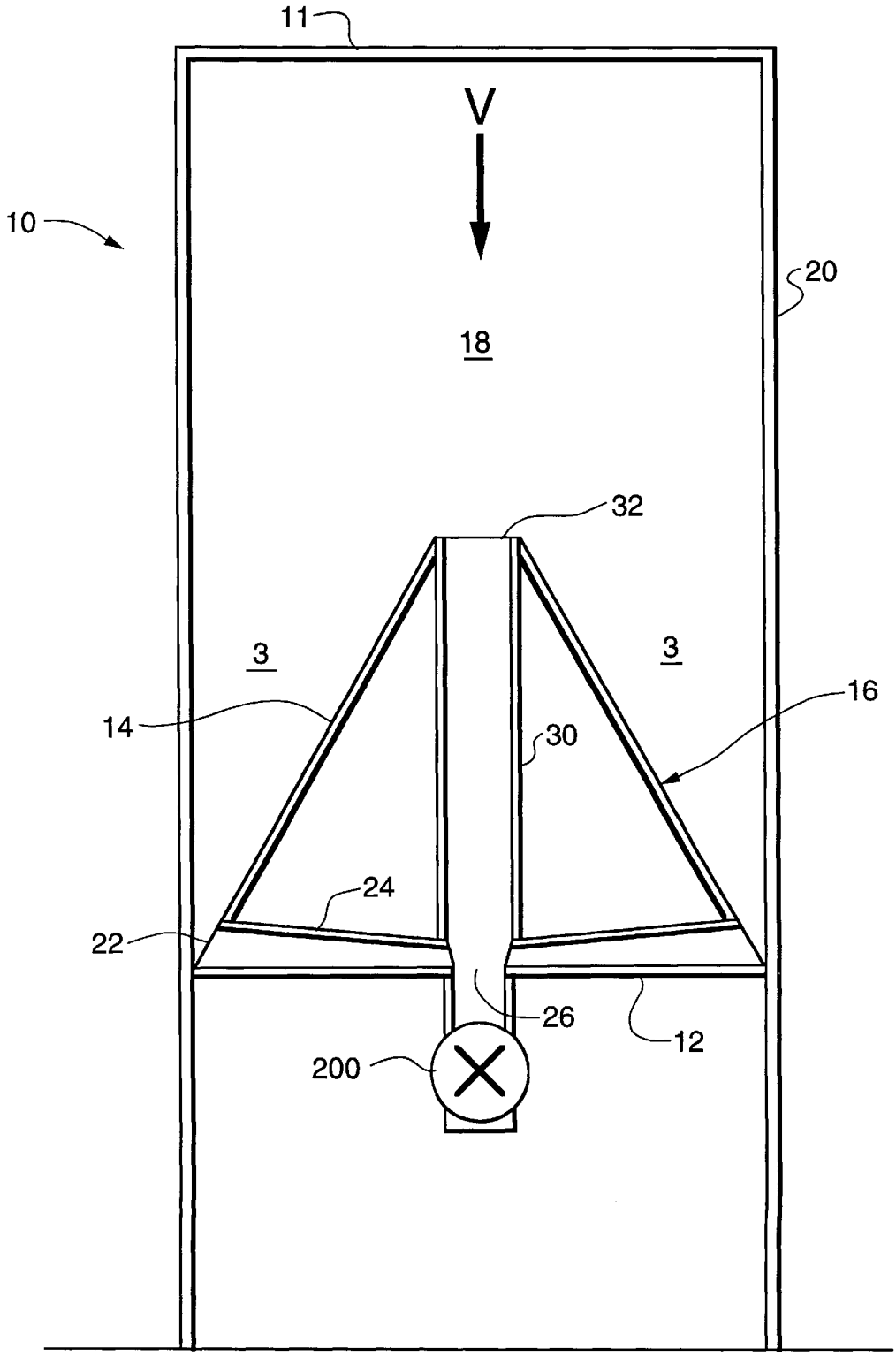
FIG. 1 is a cross-sectional view of a silo in accordance with a preferred embodiment of the invention.

FIG. 1 illustrates a silo 10 in accordance with a preferred embodiment of the invention. Although not shown, material supply means are provided in the upper region 11 of the silo 10. As shown in FIG. 1, a silo material storage area 18 is bounded by a essentially vertical circular silo wall 20. The silo contains a bottom bottom 12 which in part supports a centrally arranged cone 16, having outer sloped walls 14. An annular material storage space or chamber 3 is located between the outer cone wall 14 and silo wall 20. Chamber 3 is provided with a plurality of radially arranged, and preferably evenly spaced, material discharge outlets 22 where material is collected for transport to another part of the silo. Radially arranged material discharge particulate outlets 22 are located at the lowest points of chamber 3 to facilitate material collection and therefore are located where the outer wall 14 of cone 16 is in closest proximity to silo wall 20. The number of discharge outlets 22 located in chamber 3 will depend on the dimensions of the silo, the nature of the material the silo is designed to handle and other factors. For example, eight or more essentially regularly spaced discharge outlets 22 can typically be utilized in cement storage silos having a 10,000 metric ton capacity and a 16 meter diameter.

Material is conveyed from discharge outlets 22 via conduit means 24. Conduit means 24 can be a fluidized air conveyor means as known in the prior art. Alternatively and preferably, conduit means 24 serve as "dense phase" conveyors.

Figure 5:
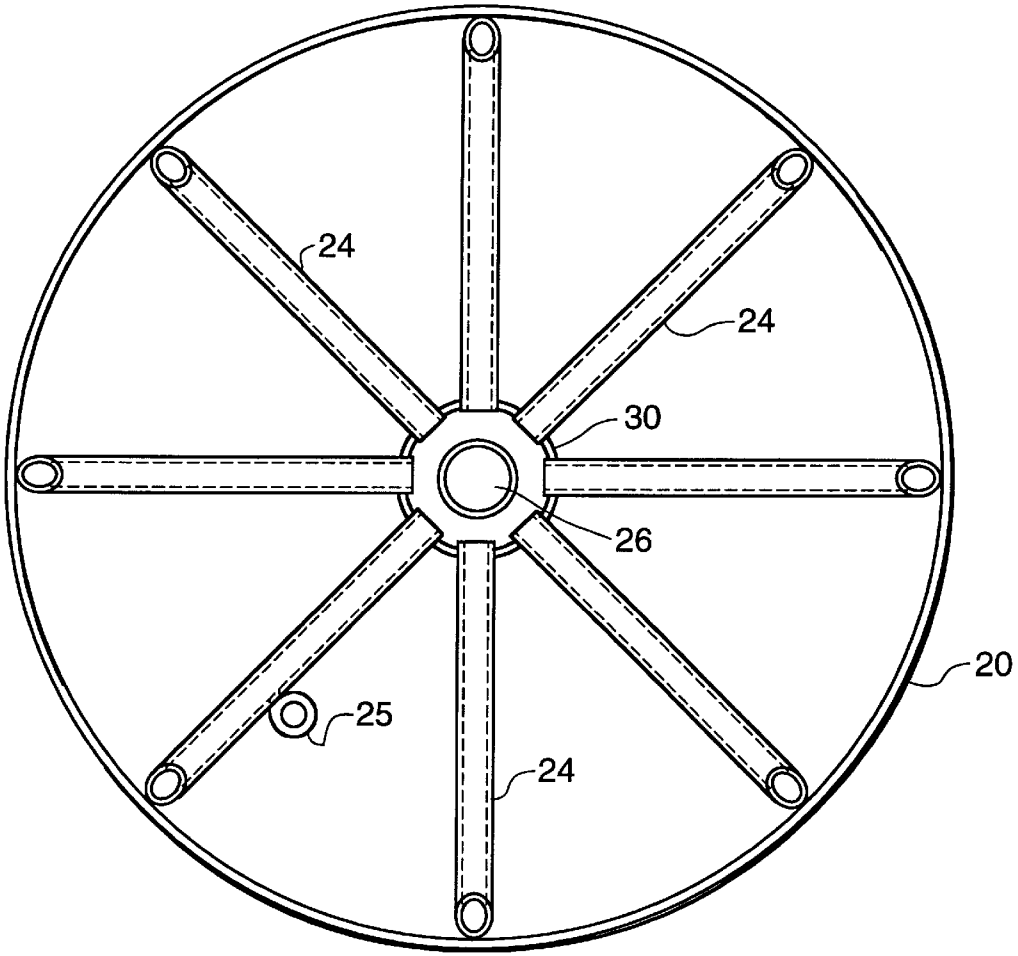

FIG. 5 illustrates a downward view, in the direction of arrow V in FIG. 1, into the interior of silo 10 showing an example of the radial spacing of conduits 24 (eight of which are shown by example) as they extend from an area proximate to silo wall 20 to the central collection point 26, which is located within vertically oriented conduit 30 (FIG. 1) and, in any event, above bottom 12 and within the body of silo 10. To facilitate the depiction of conduit means 24, inner cone 16 is not depicted in FIG. 5.

Dense phase conveying systems are characterized by utilizing lower air (or inert gas) velocities and a higher conveying pressure gradient, and the air, or inert gas, streams travel at a velocity typically not exceeding 1200 feet per minute. In contrast to dilute phase conveying systems, dense phase conveying systems utilize higher ratios of particulate material to the amount of air, or inert gas, used. Instead of keeping the particulate material in suspension in the air, or inert gas, stream, the particulate material is pushed, or extruded, through the material conveying pipe in discreet, separate dunes, balls, or "plugs". Since the air, or inert gas, cannot pass through the formed plug, the gas pressure behind the plug pushes, or extrudes, the plug down the material conveying pipe while the next plug is being formed. Typical dense phase systems must utilize a high head of air pressure. In dense phase pneumatic conveying systems conduits or conveyor tubes are practically filled with the material being conveyed, usually a granular material, and the material is moved along slowly within the conveyor tubes by relatively small amounts of air. Air pressure is applied into the conveyor tubes at the source to move the material and at various locations along the conveyor tube to compensate for frictional losses. Booster valves are coupled to the conveyor tube or conduit to provide the additional air at the various locations along the conduit. A typical dense phase system would not be ideal to move material from within a silo since it would require maintaining the silo as a pressurized vessel. The dense phase system used in the present invention has some significant differences over standard dense phase systems, in that (1) it does not utilize an air pressure head but instead relies on the material pressure to form the pressure head; (2) the material moves from the material outlet 22 to central collection point 26 primarily by gravity, with conduits 24 being inclined at angles substantially less than vertical, typically about 5°–15°; (3) the material moves in a substantially continuous plug, and not in discreet plugs as takes place in a standard dense phase system; (4) standard air boosters 25, (which are partially shown on one of the conduits 24 in FIG. 5) are employed along the length of the dense phase conveyors—and are typically spaced every 6"–12"—to inset a small amount of air into the pipe conveyors. In the present invention, the air inserted via the boosters is the only air utilized in moving the material within the silo and is typically less than about 5 cfm, which is much less than even the relatively small amounts that are utilized in standard dense phase systems via air boosters. The air is utilized essentially to "grease" the conduits, i.e. to cut down on friction within the conduits, which can actually stop the flow of material, and to thereby optimize the effect of gravity to move the material.

The use of the dense phase system of the present invention can enable the elimination of the valving, such as rotary metering flow control valves as may be used with fluidized air conveyor conduits, which are used in prior systems to control the withdrawal of the material.

Referring again to FIG. 1, rather than having the conduits 24 convey material to a collection point located outside the silo, it is a preferred feature of the present invention that conduits 24 convey material to a central collection and withdrawal point 26 located within the interior of silo 10. As depicted, collection and withdrawal point 26 is located at the bottom of an essentially vertically oriented conduit 30 through which material located in area 18 will travel. Conduit 30, in horizontal cross section, can be any of a number of shapes, i.e., circular. oval shaped, rectangular, etc. and the present invention should not be limited by implying a specific shape for the conduit. The depicted embodiment is of a tubular column 30 through has one end 32 located approximately at the apex of the inner cone 16 and its other end 26, located at approximately the center of the base of inner cone 16, serving both as material discharge point in the bottom, central portion, of the silo and the area into which the material conveying conduits 24 feed.

The dimensions of conduit 30 will be dependent on various factors as the size of the silo, the material being stored, etc. For example, for a sixteen meter diameter cement silo, as described above, the diameter of tubular column 30 can be approximately one meter.

One of the advantages of utilizing column 30 and its associated centrally located discharge point 26 is that, depending on the configuration of the silo, at least one half, and generally as much as about two thirds of the stored material can be discharged from discharge point 26 by gravity without need for power consumption. There will only be a need to utilize, for example, aeration blowers or the like during clean out or to remove the remaining material inventory, such as the material in area 3.

In the present invention the material flow conduits 24, when a dense phase system is employed, can be started and stopped without opening or closing a flow control valve positioned in the flow streams.

Except for master outlet valve 200 (as depicted in FIG. 1) there are, when a dense phase system is used, no valves in the silo withdrawal system yet material can be selectively removed through any combination of one or more conduits 24 at any one time. The discharge through 24 is controlled by starting and stopping air flow to the boosters or also by applying air pressure (flow) to discharge point 22.

Figure 2:
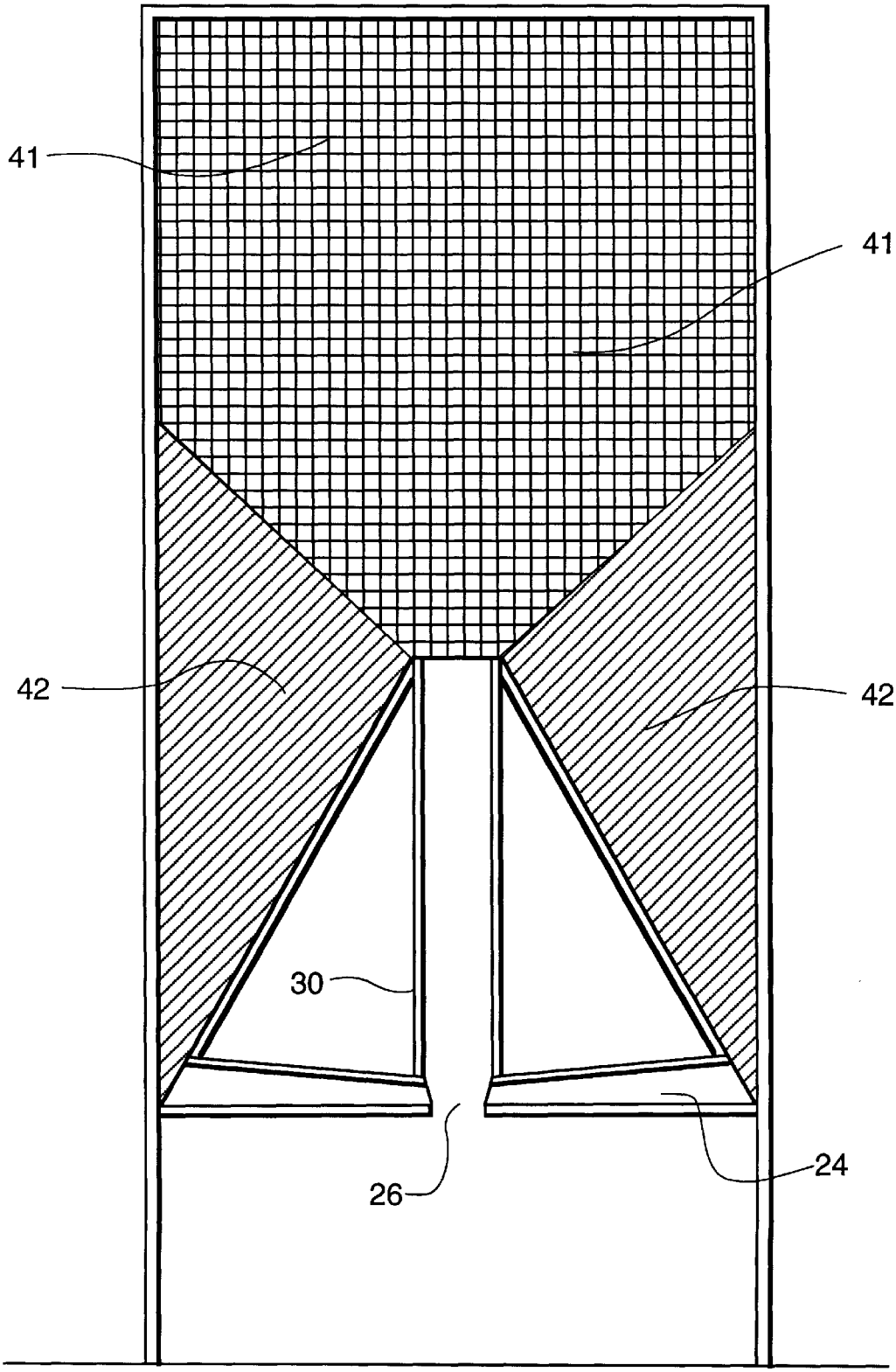
FIG. 2 is a cross-sectional view of a silo of FIG. 1 showing discharge flow areas.

FIG. 2 illustrates area 41, as represented by the cross hatched lines, of silo 10 of the embodiment of FIG. 1, which area 41 typically can be emptied through conduit 30 and central discharge point 26 of silo 10 by gravity only. Lined area 42 may be emptied via conveyor conduits 24.

Figure 3:
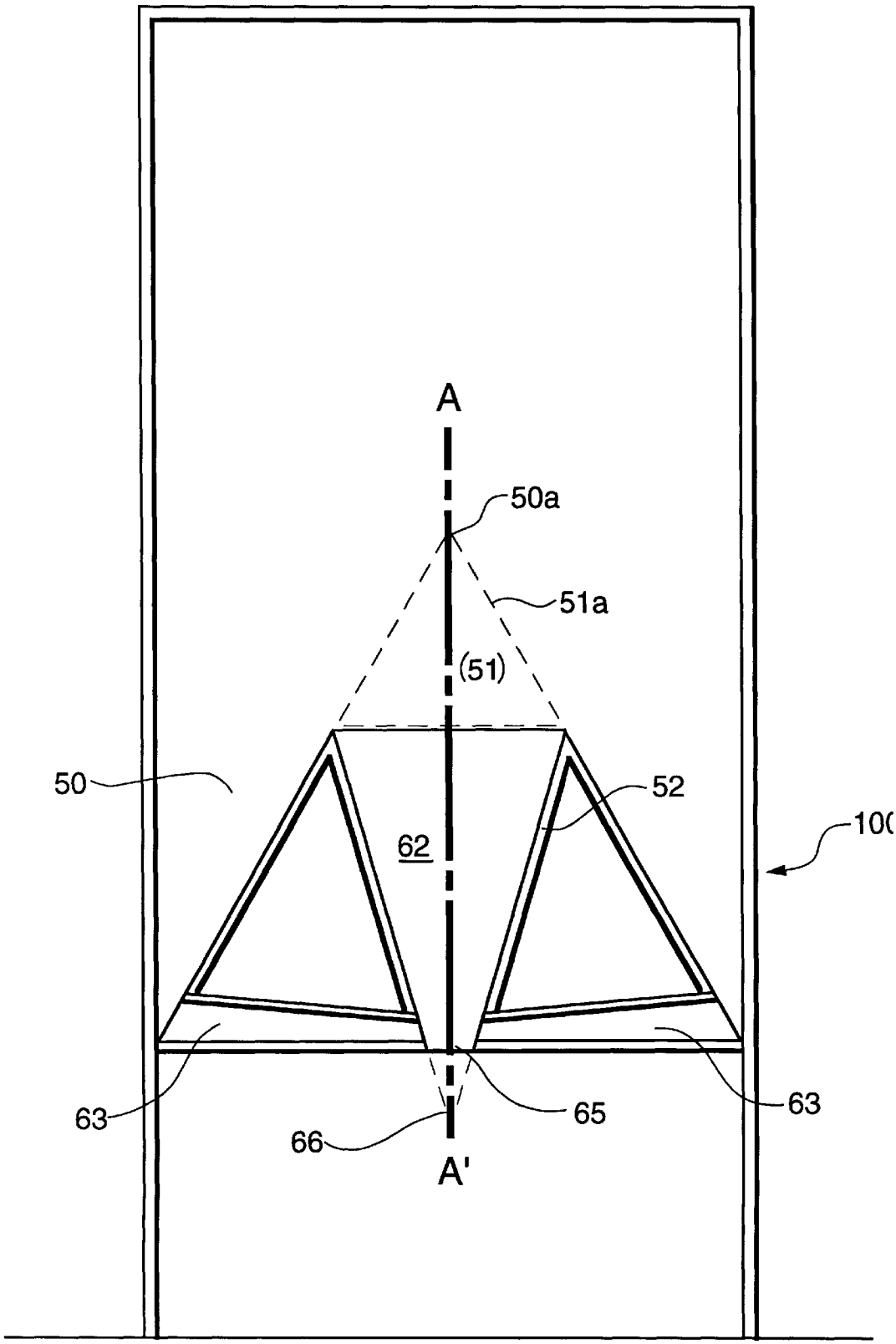
FIG. 3 is another cross-sectional view of a silo in accordance with another embodiment of the invention.

FIG. 3 illustrates another embodiment of the silo of the present invention in which, rather than employing a central column, there is a depression formed in the upwardly extending interior conical dome into which the radially extending conduits will empty. In particular, in silo 100 top portion 51 (the area of which is bound by the dotted lines 51*a*) of upwardly extending inner cone 50 is removed and the surface 52 of inner cone 50 extends down to form a downwardly extending inner cone 62. Radially extending conduits 63 will empty into material withdrawal point 65, which is located within the inner cone 62 and, consequently, within the body of silo 100. Downwardly extending inner cone 62 is positioned so that its tip 66 is located approximately on the same vertical axis A–A' that extends through the point 50*a* (which would have been the apex of cone 50 if the sides 52 of cone 50 were vertically extended) and through the center of withdrawal point 65 located in the center of the base of cone 50. Silo 100 has the capability, as does silo 10 in FIG. 1, to withdrawn at least one half of its contents by gravity through central withdrawal point 65.

Figure 4:
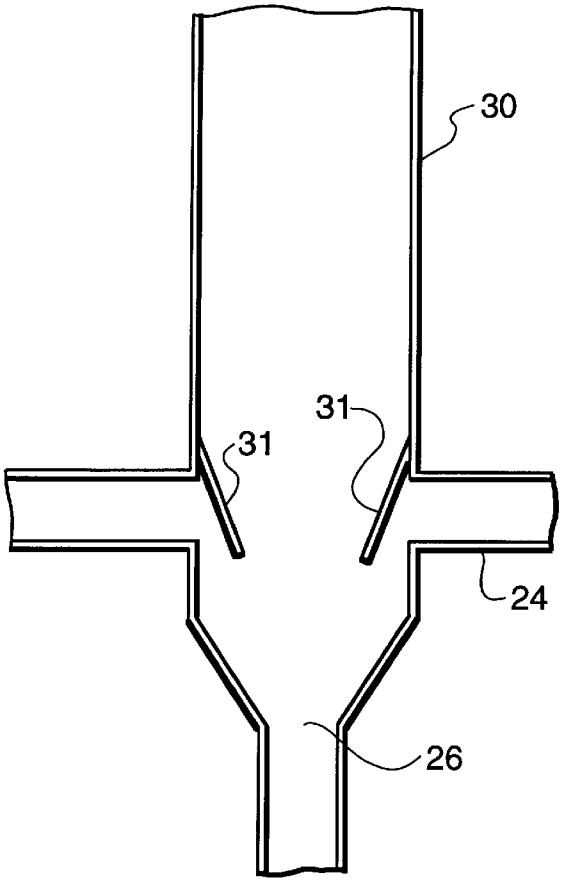

FIG. 4 shows another embodiment of the withdrawal column 30 of FIG. 1, wherein guide means 31 serve to deflect the flow of material entering column 30 from conduit 24 to thereby ensure than the flow from conduits 24 can enter column 30 while material is withdrawing from discharge point 26.

It is intended that the foregoing be a description of a preferred embodiment, but that the invention be limited solely by that which is within the scope of the intended claims.

What is claimed is:

1. A silo for pulverulent and other loose materials comprising a cylindrical silo body, at least one radially inward loose material transport conduit inside said body for transporting material from a point within the silo's interior to a loose material collection point at the cylinder centerline, said at least one conduit being a dense phase conveying conduit.

2. A silo for pulverulent and other loose materials comprising:

a. an inner silo wall defining a silo body, said body including a plurality of material outlets;

b. a centrally located, inner conical dome bounded by the inner silo wall;

c. a vertically oriented material withdrawal conduit through which said loose materials are withdrawn by gravity from the silo, said conduit having an upper end located approximately at the apex of the inner conical dome;

d. a plurality of angularly spaced material transport conduits passing radially inward, with a first end of said conduits being located at said material outlets located within the silo body near the inner silo wall and a second end of each of said conduits located at a centrally located collection point within the silo body.

3. The silo of claim 2 wherein the second end of the conduits are located near the lower end of said vertically oriented material withdrawal conduit.

4. The silo of claim 2 wherein the material transport conduits are dense phase conveying conduits.

5. A silo for pulverulent and other loose materials comprising:

a. an inner silo wall defining a silo body, said body including a plurality of material outlets;

b. a centrally located, upwardly directed open ended inner conical dome bounded by the inner silo wall;

c. a said plurality of angularly spaced material transport conduits passing radially inward, with a first end of said conduits being located at said material outlets located within the silo body near the inner silo wall and a second end of each of said conduits located at a centrally located collection point within the silo body.

6. The silo of claim 5 wherein the material transport conduits are dense phase conveying conduits.

7. The silo of claim 5, wherein the material transport conduits are fluidized air conveying conduits.

8. The silo of claim 5 wherein there is a depression in the inner conical dome in which depression the second end of the conduits are located.

9. The silo of claim 5 wherein a depression is in the form of a downwardly extending cone.

* * * * *